United States Patent [19]

Hunter

[11] 4,253,608

[45] Mar. 3, 1981

[54] PART-CIRCLE SPRINKLER WITH REVERSIBLE STATOR

[75] Inventor: Edwin J. Hunter, Rancho Santa Fe, Calif.

[73] Assignee: The Toro Company, San Marcos, Calif.

[21] Appl. No.: 41,007

[22] Filed: May 21, 1979

[51] Int. Cl.[3] ..... B05B 3/16

[52] U.S. Cl. ..... 239/206; 239/242; 239/DIG. 1

[58] Field of Search ..... 239/206, 205, 242, 240, 239/237; 415/147, 152

[56] References Cited

U.S. PATENT DOCUMENTS

| | | | |
|---|---|---|---|
| 1,187,373 | 6/1916 | Nomiya | 239/242 |
| 3,107,056 | 10/1963 | Hunter | 239/206 |
| 3,405,871 | 10/1968 | Mullan | 239/236 |
| 3,554,664 | 12/1974 | Hunter | 239/240 X |
| 3,782,638 | 1/1974 | Bumpstead | 239/242 |
| 3,785,565 | 1/1974 | Perry et al. | 239/206 |
| 3,816,021 | 6/1974 | Lewis | 415/147 |
| 4,069,976 | 1/1978 | Chauvigne | 239/242 |

FOREIGN PATENT DOCUMENTS

| | | | |
|---|---|---|---|
| 618193 | 2/1949 | United Kingdom | 415/152 |
| 630164 | 10/1949 | United Kingdom | 415/147 |

*Primary Examiner*—Robert B. Reeves
*Assistant Examiner*—Gene A. Church
*Attorney, Agent, or Firm*—Poms, Smith, Lande & Rose

[57] ABSTRACT

A part-circle sprinkler having a sprinkler head incorporating a nozzle continually oscillates between two positions. The sprinkler head is connected to a transmission driven by an impeller The impeller is driven by a reversible stator which can direct a plurality of channelized streams of water against either side of the blades of the impeller and thereby cause the impeller, sprinkler head and nozzle to rotate in a clockwise or a counterclockwise direction. The reversing stator is controlled by a resilient switching arm operated by adjustable fingers on the exterior of the sprinkler head, which set its limits of rotation. As each limit of rotation is reached, one finger exerts a torque on the switching arm. The torque causes the arm to twist until it exerts sufficient force on the reversing stator to overcome the force of the water on the stator vanes and thus reverse the direction of the stator. The sprinkler head then rotates in the opposite direction, which brings the other finger toward the switching arm. The flow of water through the sprinkler is axial from inlet to nozzle.

23 Claims, 14 Drawing Figures

Fig. 2.
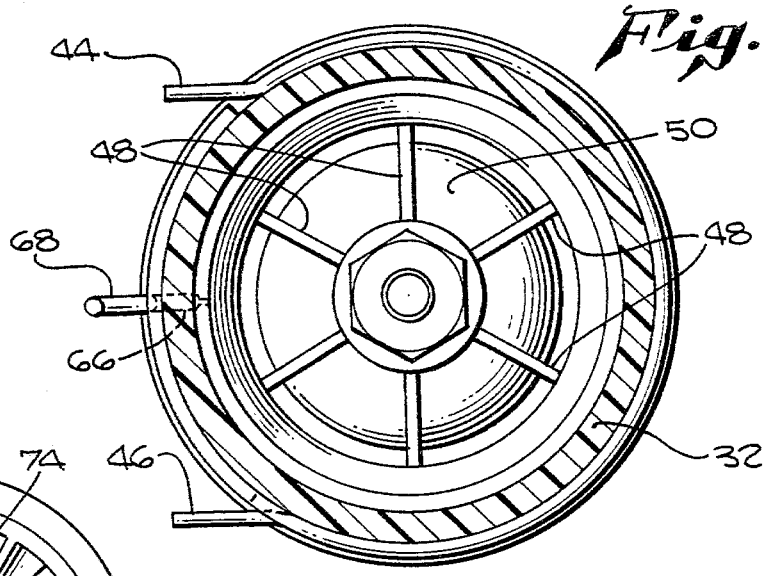
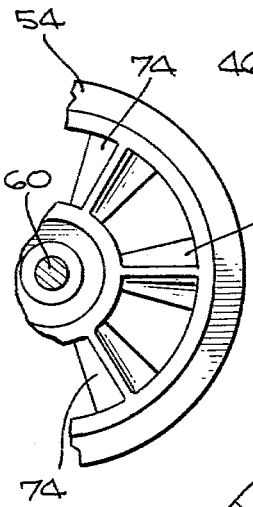
Fig. 4.
Fig. 3.
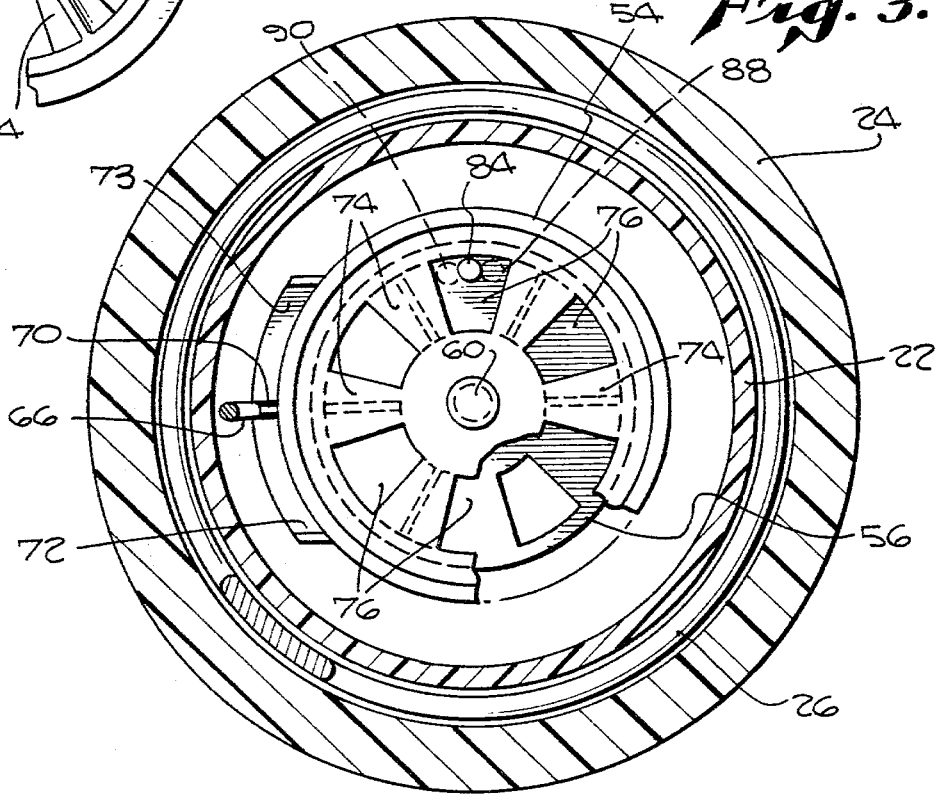

PART-CIRCLE SPRINKLER WITH REVERSIBLE STATOR

FIELD OF THE INVENTION

The present invention relates to part-circle sprinklers having nozzles which are automatically rotated between preselected first and second positions.

BACKGROUND OF THE INVENTION

Automatic part-circle sprinklers are known in the art. Many are designed to attach to underground water pipes and incorporate pop-up heads which rise above the ground when water is supplied to the sprinkler and which lie flush with the ground when not in use.

The limitations of the part-circle sprinklers found in the prior art are numerous. First, most utilize complicated control mechanisms which are susceptible to being jammed by the various debris flowing through the water pipes of most sprinkler systems. As a result, expensive screens are required to protect the control mechanisms.

Second, in many of the part-circle sprinklers found in the prior art, the limits of coverage of the sprinkler are set internally within the sprinkler and thus partial disassembly of the sprinkler is usually required when these limits are to be changed.

Third, in those sprinklers which provide a precise adjustment of the area of coverage, the sprinkler rotates only to the preset limit of rotation. As a result, the presence of any wind or a slight misadjustment of the area of coverage often results in the outer limits of the area not being sprayed with water.

Finally, most of the devices found in the prior art have no means for maintaining a constant speed of rotation when sudden changes occur in the volume of water supplied to the device. As a result, these volume changes cause erratic operation of these part-circle sprinklers.

Accordingly, it is a principal object of this invention to reduce the complexity of the control mechanism required in a part-circle sprinkler.

It is another object of this invention to simplify the adjustment of the limits of rotation of a part-circle sprinkler.

It is still another object of this invention to insure that the outer limits of the predetermined area of coverage of a part-circle sprinkler receive adequate water.

It is a final object of this invention to prevent volumetric changes in the water supplied to a part-circle sprinkler from disturbing its speed of rotation.

SUMMARY OF THE INVENTION

The present invention, in a broad aspect, involves the use of a reversing stator and accompanying actuator to control the rotation of a part-circle sprinkler. The part-circle sprinkler includes a housing adapted for connecting to a supply of water under pressure, an impeller for rotating in response to the water flowing axially through the housing and incident on the blades of the impeller, transmission means driven by the impeller, and a sprinkler head, incorporating a nozzle, adapted for rotation by the transmission.

The reversing stator is located directly below the impeller and provides one or more channelized streams of water against either side of the blades of the impeller and thereby causes the impeller, sprinkler head, and nozzle to either rotate in a clockwise or counterclockwise direction. The position of the reversing stator, and thus the angular orientation of the channelized streams, is controlled by an actuator which incorporates means for predefining the area of coverage of the part-circle sprinkler and which provides a direction-reversing stimulus to the reversing stator.

In accordance with one feature of the invention, the upwardly-directed, channelized streams are smoothly deflected against the impeller one or more vanes in the reversing stator. Each of the vanes may be symmetric and have opposing surfaces convergently curving toward an apex disposed in the path of the incoming water. By the action of the actuator in shifting these vanes on either side of the streams, the impeller is driven in a clockwise or counterclockwise direction. The shifting of the vanes can cause an angular change in the direction of the deflected water of up to 120° degrees. Contact of the reversing stator with the actuator is made in a V-shaped guide projecting from the circular wall to provide for easy assembly of the stator into the housing.

In accordance with another feature of the invention, the actuator comprises a pair of adjustable fingers or stops, which provide the initial limits of rotation of the sprinkler head, and a resilient shaft or drive arm which applies a direction-reversing stimulus to the reversing stator. The fingers or stops may be on the interior or the exterior of the sprinkler head and may be movable or fixed. In the preferred embodiment, the fingers are located on the exterior of the sprinkler head and are movable. The resilient shaft or drive arm is attached to the housing. At one end of the shaft is a crank arm which makes contact with the fingers. At the other end is a blade which rides in a slot at the bottom of the V-shaped guide in the reversing stator.

As the sprinkler head rotates, one of the fingers approaches the crank arm. When the initial limit of rotation, defined by the position of the finger, has been reached, the finger turns the crank arm and exerts a torque on the shaft. The shaft then starts to twist as the force of the water on the curved vanes prevents the reversible stator from rotating as the head moves past the limit of rotation defined by the finger. The blade prevents the shaft from turning and thus causes the torque in the shaft to rapidly accumulate. When the torque in the shaft is greater than the force of the water on the curved vanes in the reversing stator, the shaft snaps the reversing stator to an orientation, with respect to the upwardly-directed streams, that is opposite to its previous orientation. As a result, the streams are directed to the opposite side of the impeller blades and the sprinkler head reverses its direction. The process then repeats for the other finger. In this manner, the sprinkler is caused to continually oscillate between and slightly past the limits of rotation established by the fingers. The ability to rotate slightly past the limits of rotation established by the fingers provides a unique "overcenter" action which assures a positive reversing action.

In accordance with still another feature of the invention, the reversing stator mounts to the housing by means of two other stators whose primary function is to create the upwardly-directed streams which are deflected by the reversing stator against the impeller. The first or bottom stator is fixedly mounted to the bottom of the housing in the path of the incoming supply of water. This stator has vertical vanes directs the incoming supply to the second stator. The second or middle stator divides the stream of water coming from the first stator into a plurality of high velocity, upwardly-directed streams. The second stator also has vertical vanes and is movably positioned above the first stator.

The second stator includes downwardly-depending stops for preventing it from rotating and an upwardly-depending stop for limiting the rotation of the reversing stator. The rotation of the reversing stator is limited such that the V-shaped vanes may only move across the path of the upwardly-directed streams of water.

In accordance with still another aspect of the invention, all three stators are interconnected by a shaft which freely passes through the reversing stator and the bottom stator, and which is rigidly attached to the middle stator. The shaft is of such a length and interconnects the stators in such a manner that the middle stator and the reversing stator may move upwardly away from the bottom stator in response to increases in the volumetric flow of the water supply. This separation diverts some of the water away from the middle stator and allows the operation of the part-circle sprinkler to continue without a change in the speed of rotation of the nozzle. A spring is positioned between the bottom of the shaft and the bottom stator. The spring biases the middle stator and the reversing stator against the bottom stator. The strength of the spring provides a control over the speed of the transmission as water having a volumetric flow rate producing a force on the middle stator greater than that provided by the spring is diverted. This feature allows the sprinkler to operate with different size nozzles without a significant change in the nozzle rotation speed or in the pressure of the water leaving the nozzle.

In accordance with the final feature of the invention, the sprinkler may be adapted to be mounted underground and thus be of the "pop-up" head variety. In this regard, the housing may be fitted with a sleeve which would allow it to move upwardly when water is supplied to the sprinkler, the upward movement lifting the nozzle above the surface of the ground. The sleeve would incorporate a stop for limiting the upward travel of the housing and a seal for preventing water from leaking from the sleeve. Additionally, a spring would be positioned on the exterior of the housing between the bottom of the housing and the top of the sleeve. The spring would bias the housing underground when the supply of water to the sprinkler was discontinued.

Other features and advantages of the present invention will become apparent from a consideration of the following detailed description and from the accompanying drawings.

BRIEF DESCRIPTION OF THE DRAWINGS

FIG. 2 is a plan view of the invention, taken along plane II—II of FIG. 1, showing the relationship of the resilient switching arm and the adjustable fingers which define the limits of rotation of the sprinkler head;

FIG. 3 is a plan view of the invention, taken along plane III—III of FIG. 1, showing the positioning of the reversing stator relative to the second directing stator and the resilient drive arm prior to any water entering the sprinkler;

FIG. 4 is a detail view of FIG. 1, taken along plane IV—IV, showing the positioning of the vanes of the reversing stator relative to the vanes of the second directing stator;

DETAILED DESCRIPTION

Figure 1:
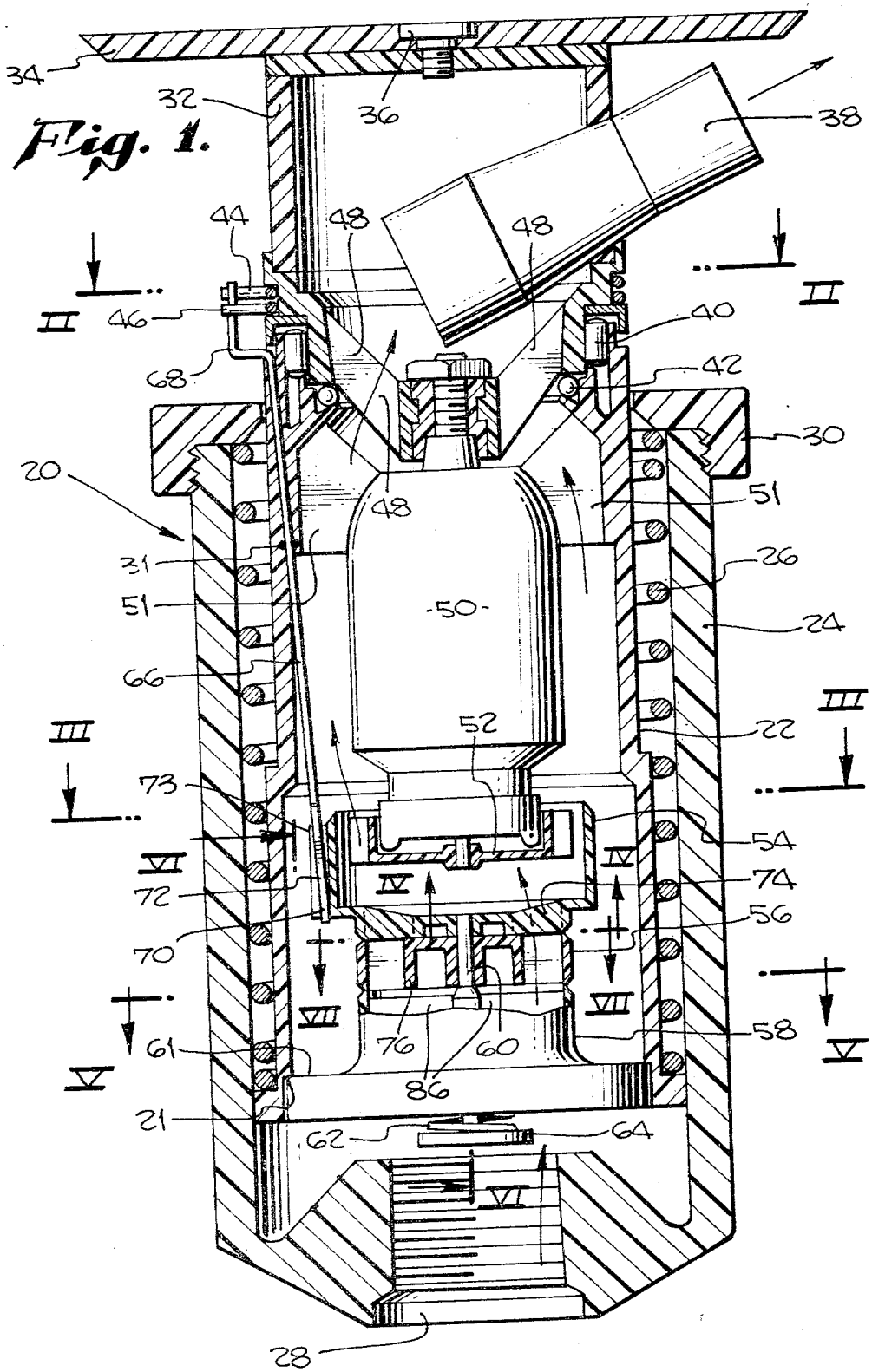
FIG. 1 is a cross-sectional view of a part-circle sprinkler constructed according to the present invention and containing a pop-up head.

Referring more particularly to the drawings, FIG. 1 shows a part-circle sprinkler 20. All the components of the sprinkler 20 are located in a housing 22. At the top of the housing 22 is mounted a rotating sprinkler head 32 containing a nozzle 38 by which water is discharged. The sprinkler head 32 attaches to the housing 22 by means of a plurality of supporting arms 48 attached to a transmission means 50 mounted within the housing 22. Movement of the sprinkler head 32 relative to the housing 22 is aided by a thrust bearing race 40. The bearing race 40 is sealed from the housing by an O-ring 42.

The sprinkler head 32 is rotated by a transmission means 50 which attaches to the housing 22 by means of a plurality of supporting braces 51. The transmission means 50 is driven by an impeller 52. The direction of the water incident upon the blade of the impeller 52 determines the direction of rotation of the impeller 52, and of the sprinkler head 32 and its accompanying nozzle 38. As discussed below, the direction of water incident on the impeller 52 is determined by a reversing stator 54 which is controlled by actuator. The actuator has three components: a switching arm 66 and two adjustable fingers 44 and 46. Also, and is seen from FIG. 1, the direction of the flow of the water through the housing is entirely axial.

In the preferred embodiment, the part-circle sprinkler 20 is of the pop-up head variety. In this regard, the housing 22 has attached to it an outer sleeve 24 which is held in position by a threaded retaining cap 30. The sleeve 24 connects to an underground conduit by means of a fitting 28. When no water is supplied to the sprinkler 20, a spring 26 biases the housing 22 into the sleeve 24 until a cover plate 34, attached to the sprinkler head 32 by screw 36, contacts the surface of the ground. When water is supplied to the sprinkler 20 through the fitting 28, the force of the water lifts the housing 22 in the sleeve 24 such that the sprinkler head 32 is positioned above the surface of the ground.

The water entering the sprinkler 20 first passes through a directing stator 58 (hereinafter referred to as the first directing stator). The flanges of the first directing stator 58 are positioned against a step 21 in the bottom of the housing 22. The stator 58 is oriented by means of a key in the housing 22 riding in a slot in the stator 58.

Figure 5:
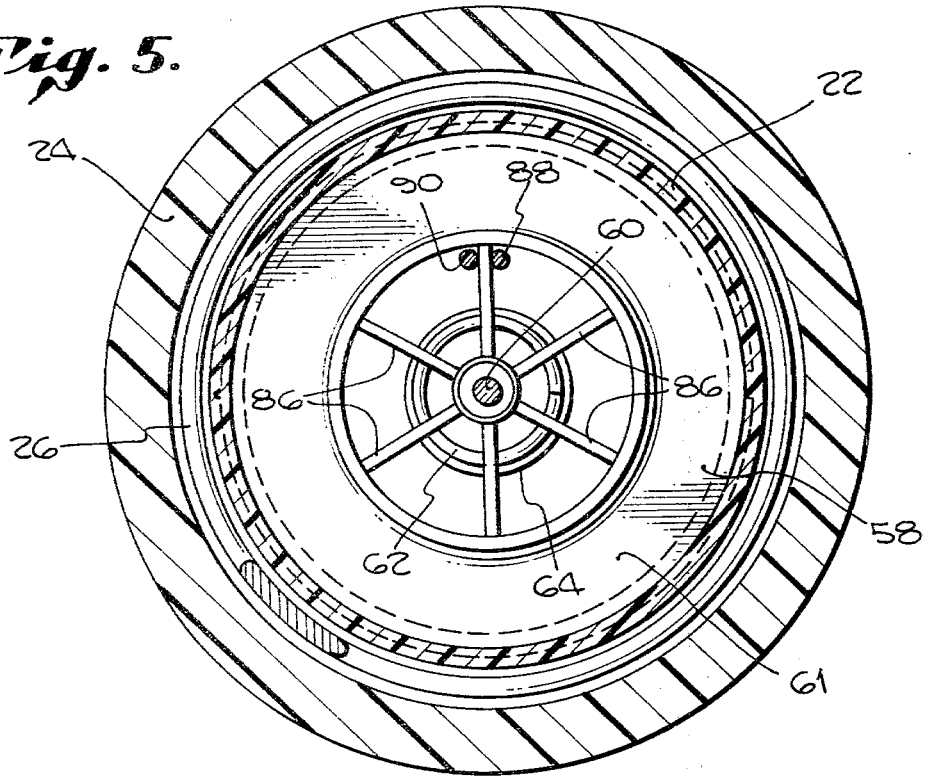
FIG. 5 is a plan view of the invention, taken along plane V—V of FIG. 1.

As can be seen from FIG. 5, the first directing stator 58 contains a flat, horizontally-oriented circular surface 61 which has a hole in its center. Structural support for the stator 58 is provided by a plurality of vanes 86. The stator 58 performs two functions. First, it directs the flow of water from the inlet to the straightening vanes 86 of a second stator 56 mounted directly above it. Second, it functions as the lower half of a bypass valve used to maintain a constant speed of nozzle rotation. As will be explained, the operation of the valve involves the lifting of the second stator 58 off of the first stator 58. Accordingly, until such lifting as occurred, the first stator 58 provides a supporting surface or seat for the second stator 56.

The second directing stator 56 is fixedly attached to a shaft 60 which passes freely through the first directing stator 58. As can be seen from FIG. 6, a pair of stops 88 and 90, depend downwardly from one of the vanes in the second directing stator 56 to straddle one of the straightening vanes 86 in the first directing stator 58. These stops 88 and 90 prevent the second directing stator 56 from rotating relative to the first directing stator 58.

Figure 7:
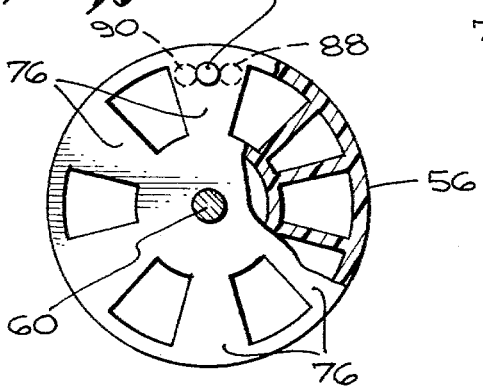
FIG. 7 is a plan view of the invention, taken along plane VII—VII of FIG. 1, showing the orientation of the vanes of the second directing stator relative to the vanes of the first directing stator.

The second directing stator 56 has a plurality of vertical "straightening" vanes 76, each which appear, in cross section, as an inverted, open, rectangular channel. As shown in FIG. 7, the orientation of the second directing stator 56 relative to the first directing stator 58 positions these vanes 76 above the water passing through the first directing stator 58. The vanes 76 in the second directing stator 56 modify the stream of water passing from the first directing stator 58 into a plurality of narrow, high velocity, streams of water. These streams are directed to a reversing stator 54 which deflects the streams against one or the other side of the blades of the impeller 52, thereby causing the impeller 52 to turn the transmission means 50 (and therefore the sprinkler head 32 and nozzle 38) in either a clockwise or a counterclockwise direction. Accordingly, it is seen that the two primary functions of the second directing stator 56 are to create a plurality of channelized or "straightened," high velocity streams of water from the water flowing from the first stator 58, and also to direct these streams against the reversing stator 54. In addition to these functions, the second stator 56 acts as a part of the bypass valve and provides support for the reversing stator 54.

Figure 6:
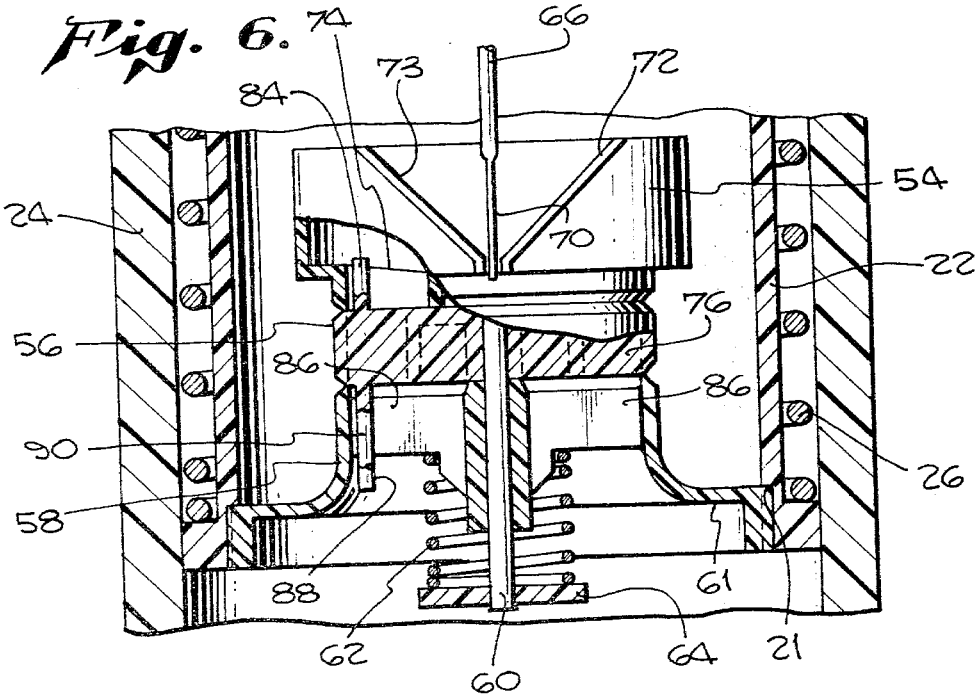
FIG. 6 is a detail view of the invention, partially in cross-section taken along line VI—VI of FIG. 1, showing the orientation of the switching arm to the reversing and directing stators.

As shown in FIGS. 1 and 6, the reversing stator 54 is rotatably attached to the shaft 60 which passes through all three stators 54, 56, and 58. As can be seen from FIG. 4, the reversing stator contains a one or more vanes 74. As shown in FIGS. 3 and 4, the cross section of each vane 74, relative to an axis parallel to the axis of rotation of the reversing stator 54, is symmetric. The opposing sides of each vane are curved surfaces which converge toward an apex disposed in the path of the channelized streams of water from the second directing stator. Such a shape provides for a smooth flow of water from the second stator 56 through the reversing stator 54, and onto the blades of the impeller 52. Although this vane shape is considered optimal, other shapes could also be used—such as a "V" shape.

The position of the vanes 74 relative to the streams of water passing from the second directing stator 56 determines the orientation of the water incident upon the blades of the impeller 52. As can be seen from FIG. 3, the second directing stator 56 has a stop 84 upwardly-depending from one of its vanes 76. This stop 84 limits the rotation of the reversing stator 54 such that its curved vanes 74 may only move across the path of the upwardly-directed streams of water from the second directing stator 56. As shown in FIG. 1, the reversing stator 54 is located directly below the impeller 52. The reversing stator 54 includes a circular wall which surrounds the impeller 52 to shield the impeller from all water other than that deflected by the vanes 74 in the reversing stator 54.

The position of the reversing stator 54, and thus the angular orientation of the deflected channelized streams from the second directing stator 56 is controlled by an actuator. The two primary elements of the actuator are a pair of adjustable fingers 44 and 46 and a resilient switching arm 66. The fingers 44 and 46 provide the initial limits of rotation of the sprinkler head 32. As shown in FIGS. 1 and 2, these fingers 44 and 46 frictionally attach to the exterior of the sprinkler head 32. In this manner, they may be moved to change the area of coverage of the sprinkler. Alternatively, the fingers may be rigidly attached to the interior of the sprinkler head 32 and thereby predefine a certain area of coverage.

Figure 12:
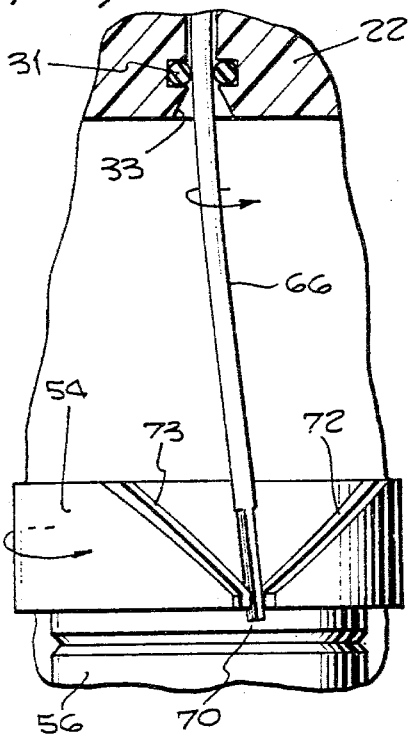
FIG. 12 and FIG. 13 are detail views of the drive arm and the reversing stator prior to the drive arm changing the orientation of the stator.
Figure 13:
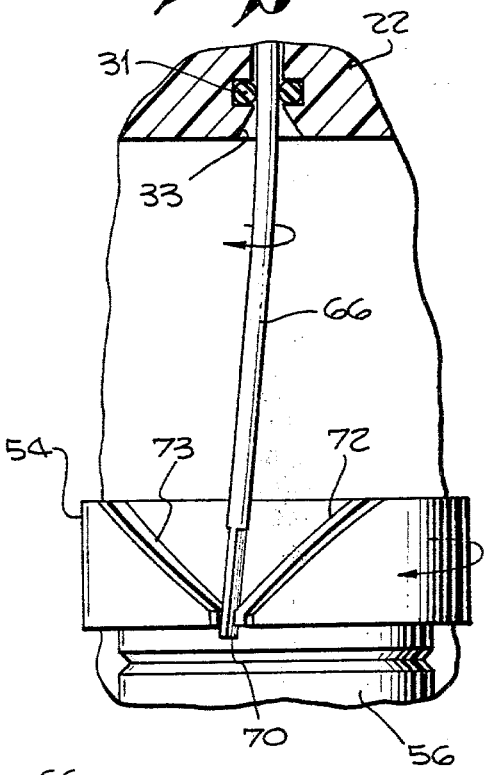

The other part of the actuator is a resilient switching arm 66. This switching arm 66 makes contact with the fingers 44 and 46 and applies a direction-reversing stimulus to the reversing stator 54. The resilient switching arm 66 passes from the interior to the exterior of the housing 22 through a small passage. As shown in FIGS. 12 and 13, the portion of the passage communicating with the interior of the sprinkler flares outwardly at surface 33 to allow movement of the switching arm 66. An O-ring seal 31 prevents water from entering the passage.

The upper end 68 of the resilient switching arm 66 is L-shaped to form a crank arm and is positioned to contact each of the fingers 44 and 46 as the sprinkler head 32 alternately rotates them toward the upper end 68 of the resilient switching arm 66. The lower end 70 of the resilient switching arm 66 is shaped as a narrow blade and makes contact with the reversing stator 54 in a V-shaped guide projecting from the circular wall of the reversing stator 54. As can be seen from FIG. 6, the V-shaped guide from the reversing stator 54 comprises a pair of members 72 and 73 projecting outwardly from and diagonally down one section of the circular wall. The V-shaped guide formed by these members 72 and 73 is open at the bottom, so as to allow the lower end 70 of the resilient switching arm 66 to be irrotatably positioned in the opening.

FIG. 3 shows the orientation of the reversing stator 54 to the second directing stator 56 and to the resilient switching arm 66 prior to any water entering the sprinkler 20. When no water is incident upon the reversing stator 54, and when the upper end 68 of the switching arm 66 is not in contact with one of the fingers 44 and 46, the switching arm 66 positions the reversing stator 54 such that the curved vanes 74 of the reversing stator 54 are approximately between the vertical vanes 76 of the second directing stator 56. As soon as water enters the sprinkler 20, the first and second directing stators produce the previously-described plurality of high velocity, channelized streams and cause the reversing stator to rotate in one direction. The upwardly-depending stop 84 from the second directing stator 56 limits this rotation such that the bottom of each curved vane 74 in the reversing stator 54 will move only to the outer edge of the channelized stream of water incident upon the vane 74. That is, the bottom of each vane 74 will become aligned with one edge of a vane 76 in the second directing stator 56, as shown in FIG. 4. In this manner, all the vanes 76 will deflect the channelized streams of water from the second directing stator 56 to the same orientation, thereby causing the impeller 52 to rotate.

The rapid rotation of the impeller 52 is geared down by the transmission means 50 to cause the sprinkler head 32 to slowly rotate. After striking the impeller, the water flows through the housing 22 to the sprinkler head 32 and passes through the nozzle 38 into the preselected area of coverage. As shown in FIG. 4, the vertical vanes 76 in the second directing stator 56 are slightly rounded at the bottom to reduce the turbulence produced as the streams pass from the first directing stator 58 to the second directing stator 56. This reduction in turbulence helps the second directing stator 56 to produce a plurality of highly-channelized streams of water to be deflected by the reversing stator 54 onto the blades of the impeller 52.

Figure 9:
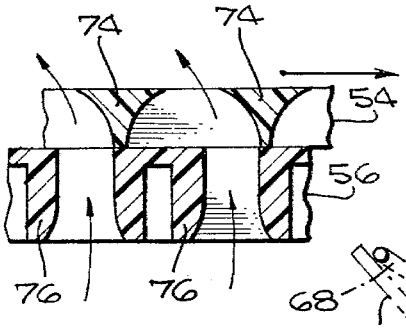
FIG. 9 is a detail view of FIG. 8, taken along plane IX—IX, showing the movement of the reversing stator relative to the second directing stator.
Figure 8:
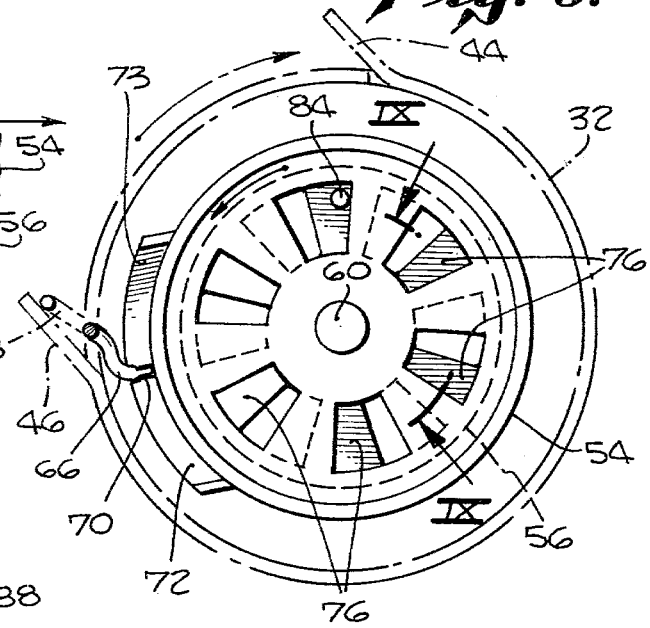
FIG. 8 is a plan view of the invention showing the operation of the reversing stator in changing the direction of the water incident on the impeller as the drive arm makes contact with one of the adjustable fingers.

As shown in FIGS. 8, 9 and 12, as the sprinkler head 32 rotates, one of the fingers 46 approaches the upper or crank arm end 68 of the resilient switching arm 66. When the initial limit of rotation, defined by the position of the finger 46 nas been reached, that finger 46 makes contact with and turns the upper end 68 of the switching arm 66 and causes a torque to be exerted on the shaft of the switching arm 66. As a result, the switching arm 66 then starts to twist at the flared opening 33 of the housing passage. As shown in FIG. 12, the force of the water on the vanes 74 in the reversing stator 54 prevents the reversing stator 54 from rotating as the sprinkler head 32 moves past the limit of rotation defined by the finger 46. The irrotatable positioning of lower or blade end 70 of the switching arm 66 in the V-shaped guide in the reversing stator 54 prevents the arm 66 from rotating and thus causes the torque in the arm to rapidly accumulate. When the torque in the arm 66 is greater than the force of the water on the curved vanes 74, the switching arm 66 releases the accumulated torque by snapping the reversing stator 54 to an orientation, with respect to the upwardly-directed streams from the second directing stator 56, that is opposite to its previous orientation. As a result, these streams are deflected to the opposite side of the impeller blades and the sprinkler head 32 thus reverses its direction as the impeller is driven in the opposite direction. The process then repeats as the sprinkler head 32 approaches the other finger 44. The "overcenter" rotation of the sprinkler head 32, which results from the resiliency of the switching arm 66, thus insures a positive reversal of direction of the reversing stator 54, which results from the resiliancy of the switching arm 66.

Figure 10:
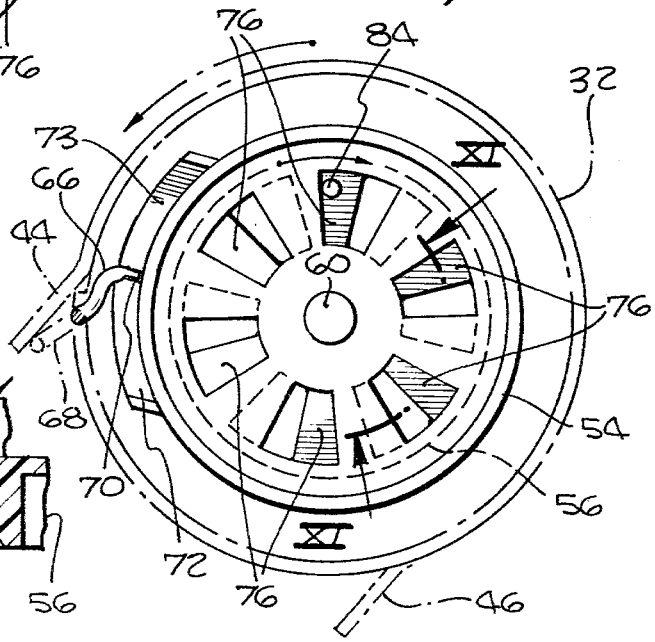
FIG. 10 shows the operation of the reversing stator in changing the direction of the water incident on the impeller when the drive arm makes contact with the other adjustable finger.
Figure 11:
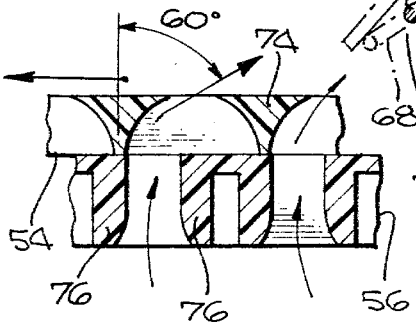
FIG. 11 is a detail view of FIG. 10, taken along plane XI—XI, showing the movement of the reversing stator relative to the second directing stator.

FIGS. 10, 11, and 13, show the process by which the direction-reversing stimulus is applied to the reversing stator 54 by the switching arm 66 as the limit of rotation defined by the other the finger 44 is reached. As before, the contacting of the finger 44 with the upper end 68 of the switching arm 66 causes a torque to be produced in the shaft 66. The torque in the arm 66 accumulates as the lower end 70 of the arm 66 is prevented from turning by the V-shaped guide projecting from the reversing stator 54. The torque in the arm 66 builds up until it is greater than the force of the water on the curved vane 74 in the reversing stator. At that time, the switching arm 66 straightens, thereby snapping the reversing stator 54 to an orientation opposite to what it had previously. The changing of the orientation of the reversing stator 56 causes the water to be deflected against the other side of the blades of the impeller 52. Consequently, the sprinkler head 32 is caused to rotate in the opposite direction and the entire cycle of oscillating between and slightly past the limits of rotation established by the fingers 44 and 46 repeats.

Referring to FIG. 11, it is seen that each of the curved vanes 74 in the reversing stator 54 deflects the water by an angle of approximately 60 degrees. Accordingly, the reversal of the reversing stator 54 by the switching arm 66 causes a net change in the direction of the water incident upon the impeller blades of approximately 120 degrees. Such a substantial change in direction aids in the positive reversing of the streams of water against the blades of the impeller.

As shown in FIGS. 6, 8 and 10, the projections 72 and 73 from the reversing stator 54, which comprise the V-shaped guide for the resilient switching arm 56, prevent the switching arm 66 from losing contact with the reversing stator 54 when the switching arm 66 is under the high torque created by the force of the water on the curved vanes 74 and the force of the finger 44 and 46 on the upper end 68 of the arm 66. That is, the high torque produces a twisting in the arm 66 which causes the bottom end 70 of the arm 66 to translate upwardly in the V-shaped guide formed by the projections 72 and 73. However, the length of the lower or blade end 70 of the switching arm 66 is such that it does not lose contact with the slot at the bottom of the V-shaped guide. The arm 66 causes the stator to quickly switch its orientation with respect to the channelized stream produced by the second directing stator 56. As can be seen from FIGS. 8 and 10, therefore, the rotational movement of the reversing stator 54 is always opposite to that of the sprinkler head 32.

Figure 14:
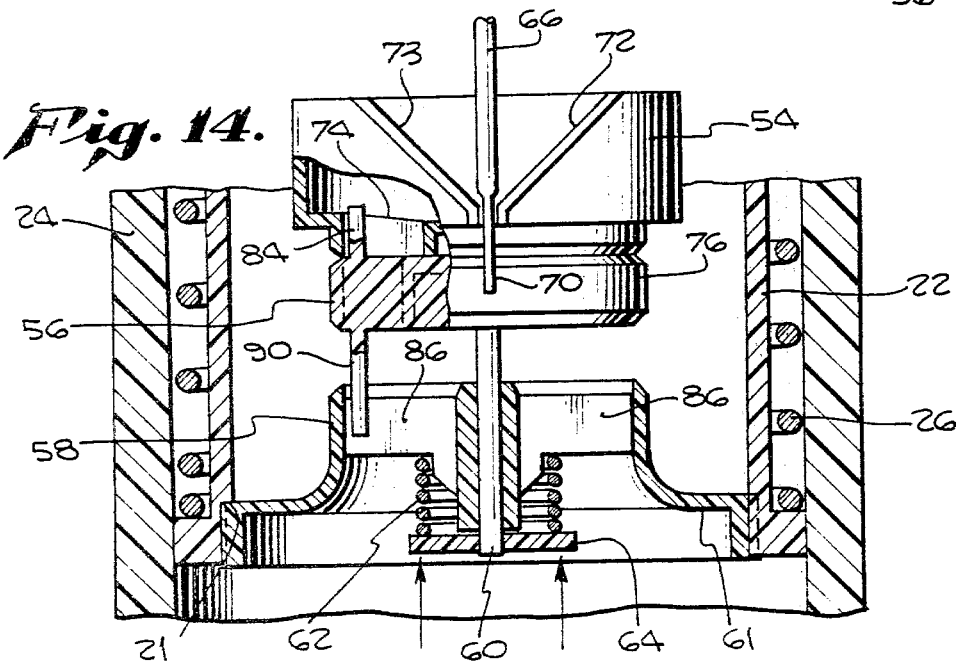
FIG. 14 shows the separation of the reversing and second directing stators away from the first directing stator as the volume of the water entering the sprinkler increases.

As is shown in detail in FIGS. 6, 14, all three stators 54, 56, 58 are interconnected by a shaft 60 which freely passes through both the reversing stator 54 and the first directing stator 58 and which is rigidly attached to the second directing stator 56. The shaft 60 is of such a length that the reversing stator 54 and the second directing stator 56 may move upwardly away from the bottom stator in response to increases in the volumetric flow of the water supply. As shown in FIG. 14, as the second directing stator 56 and the reversing stator 54 move away from the first directing stator 56, a gap is created between the first and second directing stators. This separation diverts some of the water away from the second directing stator 56 and allows the operation of the part-circle sprinkler 20 to continue with a constant speed of rotation in spite of the increased volume of water. A spring 62, positioned between the bottom end 64 of the shaft 60 and the first directing stator 58, biases the second directing stator 56 and reversing stator 54 against the first directing stator 58. The strength of the spring 62 thereby provides a control over the amount of upward movement of the second directing stator 56 and the reversing stator 54 away from the bottom stator 58, and thus provides a control over the speed of the transmission means 50. That is, the primary purpose of the valve is to maintain a constant speed of rotation even though the volume of water passing through the sprinkler has increased. This allows the same stator to be used for a wide range of flow rates. The only change necessary to accomodate the different rates is thus made in the nozzle size.

The reversing stator 54, and the first and second directing stators 56 and 58 may be molded in a one-piece structure of plastic, or other easily-formable material such as nylon or delrin. In the preferred embodiment, each stator consists of a lightweight, one-piece molded plastic body.

The foregoing description of the present invention, a preferred embodiment of the invention has been disclosed. It is to be understood that other mechanical and design variations are within the scope of the present invention. Thus, by way of example and not of limitation, the three stators could be of a material other than plastic; the sprinkler could be designed without a pop-up head for above-ground use; the adjustable fingers and resilient drive arm could be mounted completely within the housing; and, the channelized streams of water deflected by the reversing stator could be produced by means other than two separate directing stators. Accordingly, the invention is not limited to the particular arrangement which has been illustrated and described in detail.

What is claimed is:

1. In a part-circle sprinkler of the type having a housing adapted for connecting to a conduit supplying water under pressure, an impeller for rotating in response to water flowing axially through the housing and incident on the blades of the impeller, a transmission means driven by the impeller, a sprinkler head adapted for rotation by the transmission, and a nozzle mounted to the sprinkler head, the improvement comprising:

reversing stator means, located in said housing in the path of said supplied water directly below said impeller, for altering the direction of water incident on said impeller, thereby changing the direction of rotation of said impeller and said nozzle wherein said reversing stator means comprises a plurality of vane means for smoothly deflecting a plurality of channelized streams of water against the blades of said impeller;

means for mounting said reversing stator means to said housing; and actuating means for repeatably applying a direction-reversing stimulus to said reversing stator means, said actuating means mounting to said housing and contacting said reversing stator means.

2. In a part-circle sprinkler of the type having a housing adapted for connecting to a conduit supplying water under pressure, an impeller for rotating in response to water flowing axially through the housing and incident on the blades of the impeller, a transmission means driven by the impeller, a sprinkler head adapted for rotation by the transmission, and a nozzle mounted to the sprinkler head, the improvement comprising:

reversing stator means, located in said housing in the path of said supplied water directly below said impeller, for altering the direction of water incident on said impeller, thereby changing the direction of rotation of said impeller and said nozzle;

means for mounting said reversing stator means to said housing; and actuating means for repeatably applying a direction-reversing stimulus to said reversing stator means, said actuating means mounting to said housing and contacting said reversing stator means, wherein said reversing stator means comprises a lightweight, one-piece, molded plastic body comprising:

one or more vane means for smoothly deflecting at least one channelized stream of water against the blades of said impeller, said deflection being changeable by said actuating means to be incident on either side of said blades;

seating means for supporting said vane means and for rotatably mounting said reversing stator means to said means for mounting;

wall means, mounted to said seating means, for shielding said impeller from all water in said housing other than said plurality of streams from said vane means; and actuator positioning means, projecting from the exterior surface of said wall means, for attaching said actuating means to said reversing stator means.

3. The improved sprinkler defined in claim 2, wherein said vane means comprises a pair of opposing curved surfaces converging to an apex disposed in said path of supplied water.

4. The improved sprinkler defined in claim 3, wherein each of said curved surfaces deflects said channelized stream of water by approximately 60 degrees.

5. In a part-circle sprinkler of the type having a housing adapted for connecting to a conduit supplying water under pressure, an impeller for rotating in response to water flowing axially through the housing and incident on the blades of the impeller, a transmission means driven by the impeller, a sprinkler head adapted for rotation by the transmission, and a nozzle mounted to the sprinkler head, the improvement comprising:

reversing stator means, located in said housing in the path of said supplied water directly below said impeller, for altering the direction of water incident on said impeller, thereby changing the direction of rotation of said impeller and said nozzle;

means for mounting said reversing stator means to said housing; and actuating means for repeatably applying a direction-reversing stimulus to said reversing stator means, said actuating means mounting to said housing and contacting said reversing stator means, wherein said actuating means comprises:

a pair of finger means, attached to said sprinkler head, for providing initial limits of rotation of said sprinkler head, and thus of the area of coverage of said sprinkler; and resilient drive arm means, operable between said pair of finger means and said reversing stator means, for applying a direction-reversing stimulus to said reversing stator means upon contacting one of said finger means, said stimulus causing the direction of said reversing stator means, and thus of said impeller, sprinkler head, and nozzle, to reverse toward the other of said finger means when said nozzle is slightly beyond the initial limit of rotation established by the first of said finger means, said drive arm means attached to said housing in a position to make continual contact with said reversing stator means and to make contact with each of said finger means as said sprinkler head rotates said finger means toward said drive arm means.

6. In a part-circle sprinkler of the type having a housing adapted for connecting to a conduit supplying water under pressure, an impeller for rotating in response to water flowing axially through the housing and incident on the blades of the impeller, a transmission means driven by the impeller, a sprinkler head adapted for rotation by the transmission, and a nozzle mounted to the sprinkler head, the improvement comprising:

reversing stator means, located in said housing in the path of said supplied water directly below said impeller, for altering the direction of water incident on said impeller, thereby changing the direction of rotation of said impeller and said nozzle;

means for mounting said reversing stator means to said housing; and actuating means for repeatably applying a direction-reversing stimulus to said reversing stator means, said actuating means mounting to said housing and contacting said reversing stator means, wherein said reversing stator means comprises:

first directing stator means, having vertical vanes and fixedly mounted to the bottom of said housing means in the path of the incoming supply of water, for directing said incoming supply towards said reversing stator means;

second directing stator means for dividing said stream of water from said first directing stator means into one or more high velocity, upwardly-directed streams, said second directing stator means having one or more vertical vanes and being movably positioned above said first directing stator means, said second directing stator means including means for limiting the rotation of said reversing stator means relative to said second directing stator means and means for preventing the rotation of said first directing stator means relative to said second directing stator means;

shaft means, freely passing through said reversing stator means and said first directing stator means and rigidly attached to said second directing stator means, for interconnecting all of said stator means such that said second directing stator means and said reversing stator means may move upwardly away from said first directing stator means in response to increases in the volumetric flow of said supplied water, thereby diverting some of said water away from said directing stator means; and spring means, positioned between the bottoms of said shaft means and said first directing stator means, for biasing said second directing stator means against said first directing stator means, the strength of said spring means thereby providing means for controlling said upward movement of said second stator means away from said first stator means, for controlling the volume of water flowing through said second stator means and the speed of rotation of said transmission means.

7. The improved sprinkler defined in claim 6, wherein said first directing stator means comprises a lightweight, one-piece, molded plastic body comprising:

flow modification means, mounted in the bottom of said housing for changing said incoming supply of water into a circular stream of high velocity and small cross section, said flow modification means including a hole in its center through which the modified stream passes;

peripheral flange means, attaching to said flow modification means, for directing said incoming supply of water into said flow modification means, said peripheral flange means including key means for orienting said first directing stator means relative to said housing; and seating means, extending peripherally around and upwardly from said hole in said flow modification means, for providing a seat for said second directing stator means.

8. The improved sprinkler defined in claim 6, wherein said second directing stator means comprises a lightweight, one-piece, molded plastic body comprising:

flow directing means, positioned above said first directing stator means, for keeping said concentrated stream from said first directing stator means within said second directing stator means;

one or more vertical vane means, extending inwardly from said flow directing means, for splitting said concentrated stream into one or more vertical streams;

guide means, depending from said flow directing means and contacting said first directing stator means, for preventing rotation of said second directing stator means relative to said first directing stator means; and stop means, extending upwardly from one of said one or more vertical vane means and contacting said reversing stator means, for limiting the rotation of said reversing stator means relative to said second directing stator means such that said reversing stator means either deflects all of said vertical streams diagonally to one or the other side of said impeller blades.

9. In a part-circle sprinkler of the type having a housing adapted for connecting to a conduit supplying water under pressure, an impeller for rotating in response to water flowing axially through the housing and incident on the blades of the impeller, a transmission means driven by the impeller, a sprinkler head adapted for rotation by the transmission, a nozzle mounted to the sprinkler head, and wherein said sprinkler is adapted to be mounted underground the improvement comprising:

reversing stator means, located in said housing in the path of said supplied water directly below said impeller, for altering the direction of water incident on said impeller, thereby changing the direction of rotation of said impeller and said nozzle;

means for mounting said reversing stator means to said housing;

sleeving means, attaching to said conduit and surrounding the exterior walls of said housing, for allowing said housing to move upwardly when said water under pressure is supplied to said sprinkler, said upward movement lifting said nozzle above the surface of the ground;

stop means, located on said sleeving means and on said housing, for limiting the upward travel of said housing;

sealing means for preventing water from leaking from said sleeving means;

spring means, positioned on the exterior of said housing between the bottom of said housing and the top of said sleeving means, for biasing said housing in said sleeving means toward said conduit, thus positioning said housing underground when no water is supplied to said sprinkler; and actuating means for repeatably applying a direction-reversing stimulus to said reversing stator means, said actuating means mounting to said housing and contacting said reversing stator means.

10. The improved sprinkler defined in claim 2, wherein said actuator positioning means comprises a pair of members projecting outwardly from and diagonally down one section of said wall means, thereby forming a V-shaped guide, said guide including a slot at the bottom by which said actuating means switches the orientation of said reversing stator means.

11. The improved sprinkler defined in claim 5, wherein said finger means are movable and thereby provide means for adjusting the area of coverage of said sprinkler.

12. The improved sprinkler defined in claim 11, wherein said finger means are frictionally attached to the exterior of said housing.

13. The improved sprinkler defined in claim 12, wherein said housing includes passage means for allowing said drive arm means to project through the exterior of said housing, thereby making said drive arm means operable by said finger means.

14. The improved sprinkler defined in claim 5, wherein said drive arm means comprises:

resilient shaft means, supported by said housing, for transmitting said direction-reversing stimulus from said finger means to said reversing stator means;

crank arm means, located at one end of said shaft means in a position to make contact with said finger means, for exerting a torque on said shaft means in response to contacting said finger means, said torque being transmitted by said shaft means to said reversing stator means; and blade means, located at the other end of said shaft means, for engaging said reversing stator, thereby causing said torque on said shaft to increase until said torque is greater than the force of the water on said reversing stator means, whereupon said shaft means releases said torque by snapping said reversing stator means to an orientation which changes the direction of said water incident on said impeller.

15. An improved part-circle sprinkler of the type having a housing adapted for connecting to a conduit supply water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having a plurality of vertical vanes and fixedly mounted to the bottom of said housing means in the path of the incoming supply of water, for directing the incoming supply toward said impeller;

second stator means for dividing said directed stream of water from said first directing stator means into a plurality of high velocity, upwardly-directed streams, said second stator means having a plurality of vertical vanes and being movably positioned above said first stator means;

third stator means, positioned directly below said impeller and above said second stator means in the path of said upwardly-directed streams, for altering the direction of said plurality of streams of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means.

16. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having vertical vanes and fixedly mounted to the bottom of said housing means in the path of the incoming supply of water, for directing the incoming supply toward said impeller wherein said first stator means comprises a lightweight, one-piece molded plastic body comprising: flow modification means, mounted in the bottom of said housing, for changing said incoming supply of water into a circular stream of high velocity and small cross section, said flow modification means including a hole in its center through which the modified stream passes; peripheral flange mans, attaching to said flow modification means, for directing said incoming supply of water into said flow modification means, said peripheral flange means including key means for orienting said first stator means within said housing; and seating means, extending peripherally around and upwardly from said hole in said flow modification means, for providing a seat for said second stator means;

second stator means for dividing said directed stream of water from said first directing stator means into at least one high velocity, upwardly-directed stream, said second stator means having vertical vanes and being movably positioned above said first stator means;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means.

17. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having vertical vanes and fixedly mounted to the bottom of said housing means in the path of the incoming supply of water, for directing the incoming supply toward said impeller;

second stator means for dividing said directed stream of water from said first directing stator means into at least one high velocity, upwardly-directed stream, said second stator means having vertical vanes and being movably positioned above said first stator means wherein said second stator means comprises a lightweight, one-piece, molded plastic body comprising:

flow directing means, positioned above said first stator means, for keeping said concentrated stream from said first stator means within said second stator means;

a plurality of vertical vane means, extending inwardly from said flow directing means, for splitting said concentrated stream into a plurality of vertical streams;

guide means, depending from said flow directing means and contacting said first stator means, for preventing rotation of said second stator means relative to said first stator means; and stop means, extending upwardly from one of said vertical vane means and contacting said third stator means, for limiting the rotation of said third stator means relative to said second stator means such that said third stator means either deflects all of said vertical streams diagonally to one or the other side of said impeller blades;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means.

18. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having vertical vanes and fixedly mounted to the bottom of said housing means in the path of the incoming supply of water, for directing the incoming supply toward said impeller;

second stator means for dividing said directed stream of water from said first directing stator means into at least one high velocity, upwardly-directed stream, said second stator means having vertical vanes and being movably positioned above said first stator means;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means wherein said third stator means comprises a lightweight, one-piece, molded plastic body comprising:

one or more vane means for smoothly deflecting at least one channelized stream of water against the blades of said impeller, said deflection being changeable by said actuating means to be incident on either side of said blades;

seating means for supporting said vane means and for rotatably mounting said third stator means to said means for mounting;

wall means, mounted to said seating means, for shielding said impeller from all water in said housing other than said plurality of streams from said vane means; and actuator positioning means for attaching said actuating means to said third stator means, said actuator positioning means comprising a pair of members projecting outwardly from and diagonally down one section of said wall means, thereby forming a V-shaped guide, said guide including a slot at the bottom by which said actuating means attaches to and switches the orientation of said third stator means.

19. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having vertical vanes and fixedly mounted to the bottom of said housing means in the path of the incoming supply of water, for directing the incoming supply toward said impeller;

second stator means for dividing said directed stream of water from said first directing stator means into at least one high velocity, upwardly-directed stream, said second stator means having vertical vanes and being movably positioned above said first stator means;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means wherein said actuating means comprises: a pair of movable finger means, frictionally attaching to the exterior of said housing, for providing initial limits of rotation of said sprinkler head and thus of the area of coverage of said sprinkler; resilient shaft means, operable between said pair of finger means and said third stator means, for applying a direction-reversing stimulus to said third stator means upon contacting one of said finger means, said stimulus causing the direction of said third stator means, and thus of said impeller, sprinkler head and nozzle, to reverse toward the other of said finger means when said nozzle is slightly beyond the initial limit of rotation established by the first of said finger means, said shaft means supported by and passing from the interior to the exterior of said housing, said shaft means including crank arm means, located at one end of said shaft means in a position to make contact with each of said finger means as said sprinkler head rotates said finger means towards said crank arm means, for exerting a torque on said shaft means in response to contacting said finger means, said torque being transmitted by said shaft means to said third stator means, and blade means, located at the other end of said shaft means, for initially preventing said shaft means from rotating while said third stator means is stationary, thereby causing said torque on said shaft to increase until said torque is greater than the force of water on said third stator means, whereupon said shaft means releases said torque by snapping said third stator means to an orientation which changes the direction of said water incident on said impeller; and means for interconnecting all of said stator means.

20. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein the improvement comprises:

first stator means, having vertical vanes and fixedly mounted to the bottom of said housing means in the path of the incoming supply of water, for directing the incoming supply toward said impeller;

second stator means for dividing said directed stream of water from said first directing stator means into at least one high velocity, upwardly-directed stream, said second stator means having vertical vanes and being movably positioned above said first stator means;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means wherein said means for interconnecting comprises:

shaft means, freely passing through said third stator means and said first stator means and rigidly attached to said second stator means, for allowing said second stator means and said third stator means to move upwardly away from said first stator means in response to increases in the flow rate of said water supply, thereby diverting some of the water from said second stator means; and spring means, positioned between the bottoms of said shaft means and said first stator means, for biasing said second stator means against said first stator means, the strength of said spring means thereby providing means for controling said upward movement of said second stator means away from said first stator means for controlling the volume of water flowing through said second stator means and the speed of rotation of said means.

21. An improved part-circle sprinkler of the type having a housing adapted for connecting to a conduit supplying water under pressure, a sprinkler head dispensing a stream of water, a nozzle controlling the shape of the dispensed water, an impeller for rotating in response to water flowing axially through the housing and incident on the blades of the impeller and transmission means, driven by the impeller, for rotating the sprinkler head, wherein said sprinkler is adapted to be mounted underground and comprises:

sleeving means, attaching to said conduit and surrounding the exterior walls of said housing, for allowing said housing to move upwardly when said water under pressure is supplied to said sprinkler, said upward movement lifting said nozzle above the surface of the ground;

stop means, located on said sleeving means and on said housing, for limiting the upward travel of said housing;

sealing means for preventing water from leaking from said sleeving means; and spring means, positioned on the exterior of said housing between the bottom of said housing and the top of said sleeving means, for biasing said housing in said sleeving means toward said conduit, thus positioning said housing underground when no water is supplied to said sprinkler;

first stator means, having vertical vanes and fixedly mounted to the bottom of said housing means in the path of the incoming supply of water, for directing the incoming supply toward said impeller;

second stator means for dividing said directed stream of water from said first directing stator means into at least one high velocity, upwardly-directed stream, said second stator means having vertical vanes and being movably positioned above said first stator means;

third stator means, positioned directly below said impeller and above said second stator means in the path of said upwardly-directed streams, for altering the direction of water incident on said impeller, thereby changing the direction of rotation of said impeller and said nozzle;

actuating means for repeatably applying a direction-reversing stimulus to said third stator means, said actuating means mounting to said housing and contacting said third stator means; and means for interconnecting all of said stator means.

22. The part circle sprinkler of any of claims 2 through 14 wherein said reversing stator means comprises a plurality of vane means for smoothly deflecting a plurality of channelized streams of water against the blades of said impeller.

23. The part-circle sprinkler of any of claims 16 through 21 wherein:

said first stator means is provided with a plurality of vertical vanes;

said second stator means is so provided as to divide said directed stream of water into a plurality of high velocity streams; and said third stator means is so provided as to alter the direction of said plurality of streams of water incident on said impeller.

* * * * *